US012595974B2

(12) United States Patent
Abe

(10) Patent No.: US 12,595,974 B2
(45) Date of Patent: Apr. 7, 2026

(54) CERAMIC THERMAL DEVICE WITH THREE-LAYER VAPOR CHAMBER

(71) Applicant: KYOCERA Corporation, Kyoto (JP)

(72) Inventor: Yuichi Abe, Satsumasendai (JP)

(73) Assignee: KYOCERA Corporation, Kyoto (JP)

( * ) Notice: Subject to any disclaimer, the term of this patent is extended or adjusted under 35 U.S.C. 154(b) by 145 days.

(21) Appl. No.: 18/279,010

(22) PCT Filed: Feb. 17, 2022

(86) PCT No.: PCT/JP2022/006476
§ 371 (c)(1),
(2) Date: Aug. 25, 2023

(87) PCT Pub. No.: WO2022/181453
PCT Pub. Date: Sep. 1, 2022

(65) Prior Publication Data

US 2024/0142179 A1 May 2, 2024

(30) Foreign Application Priority Data

Feb. 26, 2021 (JP) ..... 2021-030210

(51) Int. Cl.
*F28D 20/02* (2006.01)
*F28D 15/02* (2006.01)
(Continued)

(52) U.S. Cl.
CPC ..... *F28D 20/021* (2013.01); *F28D 15/0283* (2013.01); *F28F 3/086* (2013.01);
(Continued)

(58) Field of Classification Search
CPC ..... H01L 23/427; F28D 15/0233; F28D 15/0283; F28D 15/0266; F28D 15/043; F28F 3/10
See application file for complete search history.

(56) References Cited

U.S. PATENT DOCUMENTS 2,782,010 A * 2/1957 Simpelaar ..... F28F 9/0278 165/167
2002/0192531 A1* 12/2002 Zimmerman ..... H01M 8/2483 429/492

(Continued)

FOREIGN PATENT DOCUMENTS

JP S53-95146 U 8/1978
JP 53-106961 A 9/1978

(Continued)

*Primary Examiner* — Paul Alvare
(74) *Attorney, Agent, or Firm* — Procopio, Cory, Hargreaves & Savitch LLP

(57) ABSTRACT

A thermal device according to the present disclosure is a thermal device that utilizes latent heat of a phase transformation substance. The thermal device according to the present disclosure includes a ceramic container and a sealing portion. The ceramic container includes a phase transformation region in which the phase transformation substance is sealed, a frame region surrounding the phase transformation region, and a communication path configured to connect the phase transformation region with the outside. The sealing portion blocks the communication paths. The communication path is located in the frame region.

11 Claims, 9 Drawing Sheets

(51) Int. Cl.
*F28F 3/08* (2006.01)
*F28F 3/10* (2006.01)
*F28F 21/04* (2006.01)

(52) U.S. Cl.
CPC ..... *F28F 3/10* (2013.01); *F28F 21/04* (2013.01); *F28F 2230/00* (2013.01)

(56) References Cited

U.S. PATENT DOCUMENTS

| | | | | |
|---|---|---|---|---|
| 2005/0200001 | A1* | 9/2005 | Joshi | F28F 3/08 257/714 |
| 2007/0056711 | A1 | 3/2007 | Ohsawa | |
| 2009/0020274 | A1* | 1/2009 | Kawabata | H01L 23/427 29/890.03 |
| 2009/0178784 | A1* | 7/2009 | Wang | B23P 15/26 165/104.26 |
| 2010/0008043 | A1 | 1/2010 | Yajima et al. | |
| 2018/0156545 | A1* | 6/2018 | Delano | F28D 15/043 |
| 2019/0249928 | A1 | 8/2019 | Zhou et al. | |
| 2019/0360762 | A1* | 11/2019 | Aoki | F28D 15/0233 |
| 2020/0025458 | A1* | 1/2020 | Takahashi | F28D 15/0266 |
| 2021/0168969 | A1 | 6/2021 | Takahashi et al. | |
| 2021/0310745 | A1* | 10/2021 | Ohsawa | F28D 15/0283 |
| 2024/0130083 | A1 | 4/2024 | Takahashi et al. | |

FOREIGN PATENT DOCUMENTS

| | | | |
|---|---|---|---|
| JP | 54-042973 | U | 3/1979 |
| JP | 1-285791 | A | 11/1989 |
| JP | 2002-81874 | A | 3/2002 |
| JP | 4035155 | B1 | 1/2008 |
| JP | 2012-132582 | A | 7/2012 |
| JP | 2021-014981 | A | 2/2021 |
| KR | 10-2009-0045146 | A | 5/2009 |
| KR | 10-2010-0007757 | A | 1/2010 |
| WO | 2018/139568 | A1 | 8/2018 |

* cited by examiner

CERAMIC THERMAL DEVICE WITH THREE-LAYER VAPOR CHAMBER

CROSS-REFERENCE TO RELATED APPLICATIONS

This application is national stage application of International Application No. PCT/JP2022/006476, filed on Feb. 17, 2022, which designates the United States, incorporated herein by reference, and which claims the benefit of priority from Japanese Patent Application No. 2021-030210, filed on Feb. 26, 2021, the entire contents of which are incorporated herein by reference.

TECHNICAL FIELD

The present disclosure relates to a thermal device.

BACKGROUND OF INVENTION

A thermal device using latent heat of a phase transformation substance is known. For example, a vapor chamber, which is a kind of thermal device, utilizes latent heat associated with evaporation and condensation of an actuating fluid sealed inside and releases heat from a heat-generating component by transporting heat from a high-temperature portion to a low-temperature portion.

Patent Document 1 discloses a ceramic vapor chamber that includes an actuating region in which an actuating fluid is sealed, and a hole for injecting the actuating fluid into the actuating region is formed at a part of a ceramic plate-shaped body constituting the actuating region.

CITATION LIST

Patent Literature

Patent Document 1: JP54-42973 UM-A

SUMMARY

A thermal device according to one aspect of the present disclosure is a thermal device that utilizes latent heat of a phase transformation substance, the thermal device including a ceramic container and a sealing portion. The container includes a phase transformation region in which a phase transformation substance is sealed, a frame region surrounding the phase transformation region, and a communication path configured to connect the phase transformation region with the outside. The sealing portion blocks the communication paths. The communication path is located in the frame region.

DESCRIPTION OF EMBODIMENTS

Modes (hereinafter will be referred to as "embodiments") for implementing a thermal device according to the present disclosure will be described below with reference to the accompanying drawings. The present disclosure is not limited by the embodiments. Embodiments can be appropriately combined so as not to contradict each other in terms of processing content. In the following embodiments, the same portions are denoted by the same reference signs, and overlapping explanations are omitted.

In the embodiments described below, expressions such as "constant", "orthogonal", "perpendicular", and "parallel" may be used, but these expressions do not need to be exactly "constant", "orthogonal", "perpendicular", and "parallel". In other words, each of the above-described expressions allows for deviations in, for example, manufacturing accuracy, positioning accuracy, and the like.

In each of the drawings referred to below, for ease of explanation, an X-axis direction, a Y-axis direction, and a Z-axis direction that are orthogonal to each other may be defined to illustrate a rectangular coordinate system in which the Z-axis positive direction is the vertically upward direction.

In the following, a heat dissipation device, specifically a vapor chamber, which utilizes latent heat associated with evaporation and condensation of an actuating fluid (an example of the phase transformation substance) and efficiently transfers heat from a high-temperature part to a low-temperature part will be described as an example of a thermal device according to the present disclosure.

Figure 1:
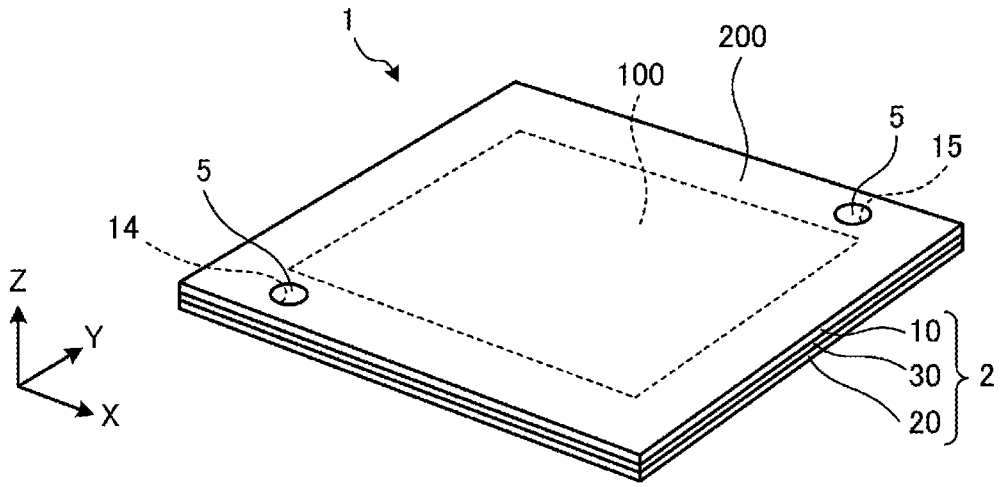
FIG. 1 is a perspective view of a heat dissipation device according to an embodiment.

An overall configuration of a heat dissipation device according to an embodiment is described with reference to FIG. 1. FIG. 1 is a perspective view of a heat dissipation device according to an embodiment.

As illustrated in FIG. 1, the heat dissipation device 1 includes a ceramic container 2. The container 2 has a first member 10, a second member 20, and an intermediate member 30. The first member 10, the second member 20, and the intermediate member 30 are all plate-shaped, and are layered such that the intermediate member 30 is sandwiched between the first member 10 and the second member 20.

The container 2 includes an actuating region 100 and a frame region 200. The actuating region 100 has an internal space in which an actuating fluid is sealed as a phase transformation substance. For example, water, a hydrocarbon-based compound, an organic liquid (for example, ethanol, methanol, or the like), or a liquid such as ammonium may be used as the actuating fluid.

The frame region 200 is a region surrounding the actuating region 100. In other words, the frame region 200 is a region outside the actuating region 100 in the heat dissipation device 1. The actuating region 100 is substantially hollow, while the frame region 200 is substantially solid.

The frame region 200 is a region intentionally formed wide in order to suppress, for example, the leakage of the actuating fluid or the vapor of the actuating fluid from the interface between the first member 10 and the intermediate member 30 or between the second member 20 and the intermediate member 30. The frame region 200 is also a region to suppress the entry of the external atmosphere into the internal space of the actuating region 100 through the interface (that is, to ensure the sealing characteristic).

The container 2 has a plurality of (in this case, two) communication paths 14, 15 that connect the internal space of the actuating region 100 with the outside. For example, of the communication paths 14, 15, the communication path 14 is used as an actuating fluid injection hole, while the communication path 15 is used as a gas discharge hole. In this case, in the manufacturing process of the heat dissipation device 1, the actuating fluid is injected into the internal space of the actuating region 100 through the communication path 14 and, accordingly, a gas present in the internal space of the actuating region 100 is discharged externally through the communication path 15. The communication path 14 is located in the vicinity of one of four corners of the first member 10, and the communication path 15 is located in the vicinity of another corner located diagonally opposite the communication path 14.

The heat dissipation device 1 does not necessarily have the plurality of communication paths 14, 15. For example, the heat dissipation device 1 may be configured to include only one of the communication paths 14, 15.

The communication paths 14, 15 are blocked by a sealing portion 5. For the sealing portion 5, for example, a resin member, a metal member, a glass member, a ceramic member, or the like can be used. The sealing portion 5 may be flush with the upper surface of the first member 10 or may be raised from the upper surface of the first member 10. As will be described later, a helical insert may be used as a part of the sealing portion 5. When the communication paths 14 and 15 are blocked by the sealing portion 5, the internal space of the heat dissipation device 1 is sealed and the actuating fluid is enclosed in the actuating region 100. As described above, the heat dissipation device 1 is a sealed container with a sealed interior.

The actuating fluid fills the internal space of, for example, the actuating region 100, at a ratio of from 10 vol % to 95 vol % with respect to the total volume of the internal space. Preferably, the ratio is from 30 vol % to 75 vol %. More preferably, the ratio is from 40 vol % to 65 vol %. The remaining portion of the internal space of the actuating region 100 other than the portion where the actuating fluid is present is in a vacuum state including some of the vaporized actuating fluid. This maintains vapor-liquid equilibrium in high-temperature environments, making it less prone to dryout, while allowing efficient thermal diffusion in low-temperature environments, thus achieving a high thermal diffusion characteristic in a wide temperature range.

The first member 10, the second member 20, and the intermediate member 30 are made of a ceramic. Examples of the ceramic constituting the first member 10, the second member 20, and the intermediate member 30 that can be used include, for example, alumina ($Al_2O_3$), zirconia ($ZrO_2$), silicon carbide (SiC), silicon nitride ($Si_3N_4$), aluminum nitride (AlN), cordierite ($Mg_2Al_3(AlSi_5O_{18})$), and silicon impregnated silicon carbide (SiSiC). The ceramic constituting the first member 10, the second member 20, and the intermediate member 30 may be a single crystal.

A metal heat dissipation device is difficult to make thinner due to the difficulty in obtaining rigidity due to materials and manufacturing methods. Since the metal heat dissipation device includes a metal portion that contacts the actuating fluid, there is room for improvement in corrosion resistance. In contrast, since the heat dissipation device 1 according to the embodiment is composed of the first member 10, the second member 20, and the intermediate member 30 which are all made of a ceramic, it is easier to make the device thinner and more corrosion-resistant than the heat dissipation device made of metal.

In the example illustrated in FIG. 1, the heat dissipation device 1 is placed with the first member 10 facing upward, but the installation state of the heat dissipation device 1 is not limited to the example illustrated in FIG. 1. For example, the heat dissipation device 1 may be placed with the first member 10 facing downward. The heat dissipation device 1 is not limited to the horizontal arrangement as illustrated in FIG. 1, but may be arranged vertically.

Since ceramics are brittle, an important issue for the heat dissipation device including a ceramic container is how to ensure durability against a stress generated associated with, for example, phase transformation of the actuating fluid.

Here, the vapor chamber described in Patent Document 1 includes a communication path for injecting the actuating fluid in the actuating region. In the actuating region, the thickness of the ceramic is reduced by an amount corresponding to the internal space. Therefore, the chamber described in Patent Document 1 with the communication path provided in the actuating region easily lacks durability against stress and has a risk of generation of cracks or the like in the container. When the container is cracked, a dryout of the actuating fluid enclosed in the internal space may occur to deteriorate the heat dissipation efficiency.

In contrast, the heat dissipation device 1 according to the embodiment includes the communication paths 14, 15 located in the frame region 200. Unlike the actuating region 100, the frame region 200 is solid. The communication paths 14, 15 located in the frame region 200 can increase durability compared to the case in which the communication paths 14, 15 are located in the actuating region 100. Thus, the heat dissipation device 1 according to the embodiment can enhance durability.

The heat dissipation device 1 according to the embodiment can also enhance the heat dissipation characteristic, because the actuating region 100 can have a wider effective space than the case in which the communication paths 14, 15 are located in the actuating region 100.

The frame region 200 where the communication paths 14, 15 are located is made of the ceramic material same as or similar to that of the actuating region 100, making it less likely to generate stress due to a difference in thermal expansion. Thus, the heat dissipation device 1 according to the embodiment has a high reliability.

Figure 2:
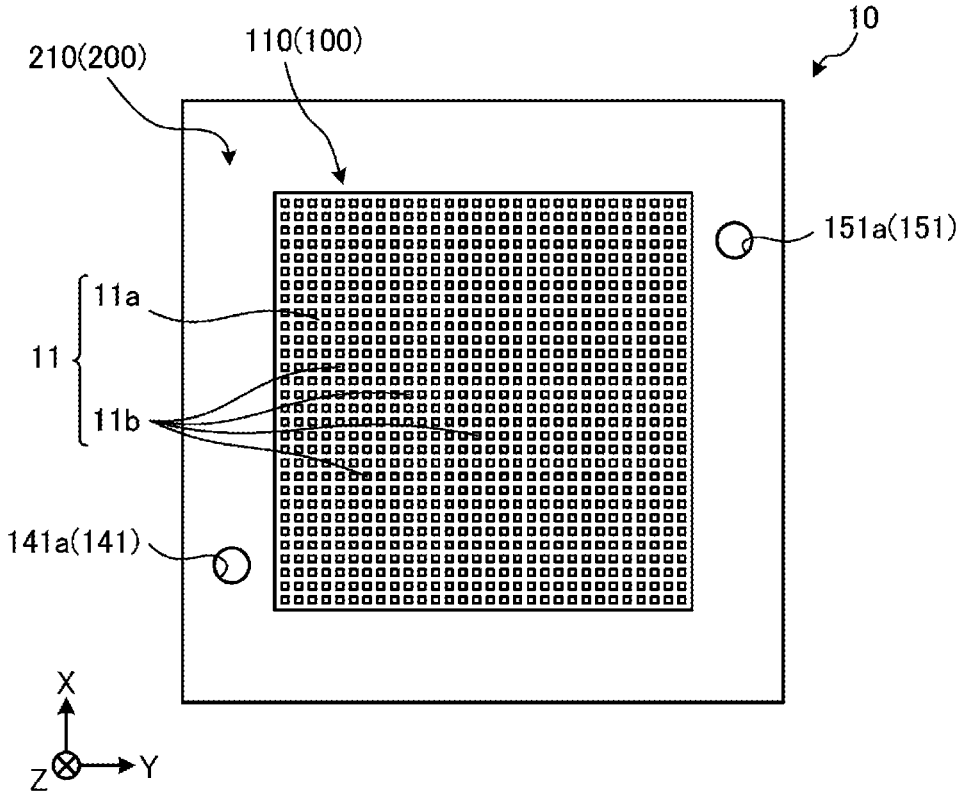
FIG. 2 is a view in which a first member according to an embodiment is viewed from a Z-axis negative direction side toward a Z-axis positive direction.

The configuration of the first member 10 will be described with reference to FIG. 2. FIG. 2 is a view in which a first member 10 according to an embodiment is viewed from the Z-axis negative direction side toward the Z-axis positive direction.

FIG. 2 illustrates a lower surface of the first member 10, specifically, a surface (third surface) facing the upper surface (first surface) of the intermediate member 30. As illustrated in FIG. 2, the first member 10 includes a first groove portion 11 having a lattice shape on the third surface.

The first groove portion 11 includes a first recessed portion 11*a* recessed with respect to the third surface and a plurality of first protruding portions 11*b* located within the first recessed portion 11*a*. The first recessed portion 11*a* is located at the center portion of the third surface, and its contour in plan view is, for example, a square. The plurality of first protruding portions 11*b* are arranged longitudinally and laterally at intervals from each other within the first recessed portion 11*a*. The first recessed portion 11*a* and the plurality of first protruding portions 11*b* make the first groove portion 11 have a lattice shape.

Hereinafter, a region where the first groove portion 11 is located on the third surface of the first member 10, will be referred to as a "first groove forming region 110". The first groove forming region 110 constitutes a part of the actuating region 100. The first member 10 also includes a first frame region 210 having a rectangular frame shape surrounding the first groove forming region 110. The first frame region 210 constitutes a part of the frame region 200.

The first frame region 210 has a plurality of (here, two) through holes 141*a*, 151*a* extending through the first member 10 in the thickness direction (here, the Z-axis direction). The through hole 141*a* constitutes a part of a first portion 141 of the communication path 14, and the through hole 151*a* constitutes a part of a first portion 151 of the communication path 15.

A heat source is disposed at the center portion of the upper surface (fifth surface) located opposite to the lower surface (third surface) of the first member 10.

Figure 3:
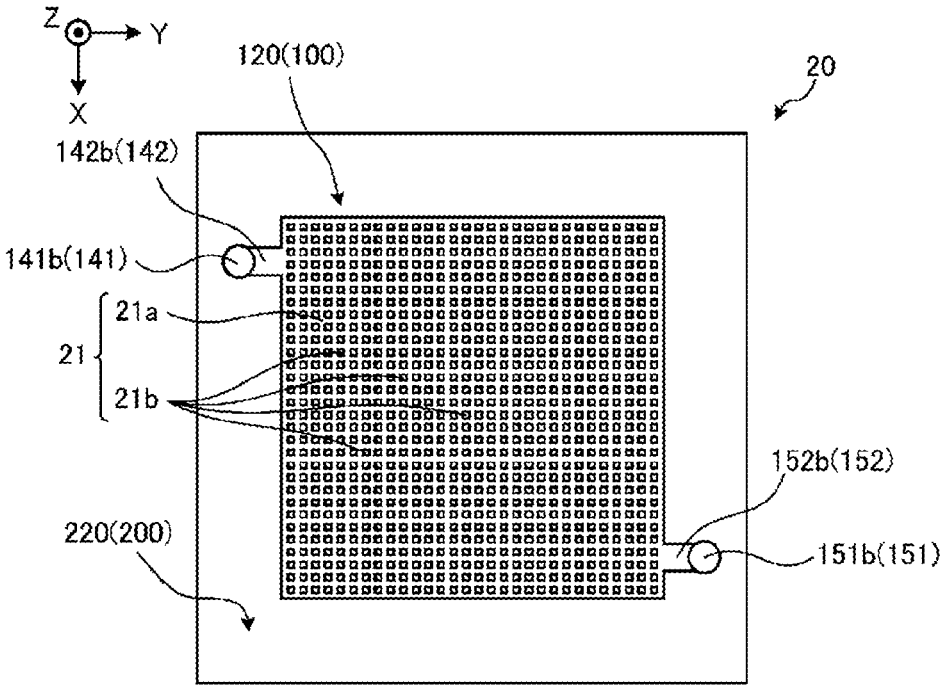
FIG. 3 is a view in which a second member according to an embodiment is viewed from a Z-axis positive direction side toward a Z-axis negative direction.

The configuration of the second member 20 will be described with reference to FIG. 3. FIG. 3 is a view in which the second member 20 according to the embodiment is viewed from the Z-axis positive direction side toward the Z-axis negative direction.

FIG. 3 illustrates the upper surface of the second member 20, specifically, the surface (the fourth surface) facing the lower surface (the second surface) of the intermediate member 30. As illustrated in FIG. 3, the second member 20 includes a second groove portion 21 having a lattice shape on the fourth surface.

The second groove portion 21 includes a second recessed portion 21*a* recessed with respect to the fourth surface and a plurality of second protruding portions 21*b* located within the second recessed portion 21*a*. The second recessed portion 21*a* is located at the center portion of the fourth surface, and its contour in plan view is, for example, a square. The plurality of second protruding portions 21*b* are arranged longitudinally and laterally at intervals from each other within the second recessed portion 21*a*. The second recessed portion 21*a* and the plurality of second protruding portions 21*b* make the second groove portion 21 have a lattice shape.

Hereinafter, a region where the second groove portion 21 is located on the fourth surface of the second member 20 will be referred to as a "second groove forming region 120". The second groove forming region 120 constitutes a part of the actuating region 100. The second member 20 includes a second frame region 220 having a rectangular frame shape surrounding the second groove forming region 120. The second frame region 220 constitutes a part of the frame region 200.

The size of the second groove forming region 120 in the second member 20 is the same as the size of the first groove forming region 110 in the first member 10. The position of the second groove forming region 120 on the fourth surface of the second member 20 is the same as the position of the first groove forming region 110 on the third surface of the first member 10.

Thus, by forming the first and second groove portions 11, 21 having a lattice shape, the actuating fluid can be efficiently circulated in the internal space of the heat dissipation device 1. Note that each of the first groove portion 11 and the second groove portion 21 need not necessarily have a lattice shape.

Located in the second frame region 220 are a plurality of (here, two) recessed portions 141*b*, 151*b* recessed with respect to the upper surface (fourth surface) of the second member 20. The recessed portion 141*b* constitutes a part of the first portion 141 in the communication path 14, and the recessed portion 151*b* constitutes a part of the first portion 151 in the communication path 15.

The second frame region 220 also includes groove portions 142*b*, 152*b*. The groove portion 142*b* is a path extending in a second direction (here, the Y-axis direction) intersecting the extending direction (which is the first direction, and here, the Z-axis direction) of the first portion 141 in the communication path 14. One end of the groove portion 142*b* is open to the recessed portion 141*b* at the first portion 141, and the other end is open to the second groove forming region 120. The groove portion 152*b* is a path extending in a second direction (here, the Y-axis direction) intersecting the extending direction (which is the first direction, and here, the Z-axis direction) of the first portion 151 in the communication path 15. One end of the groove 152*b* is open to the recessed portion 151*b* at the first portion 151, and the other end is open to the second groove forming region 120.

Figure 4:
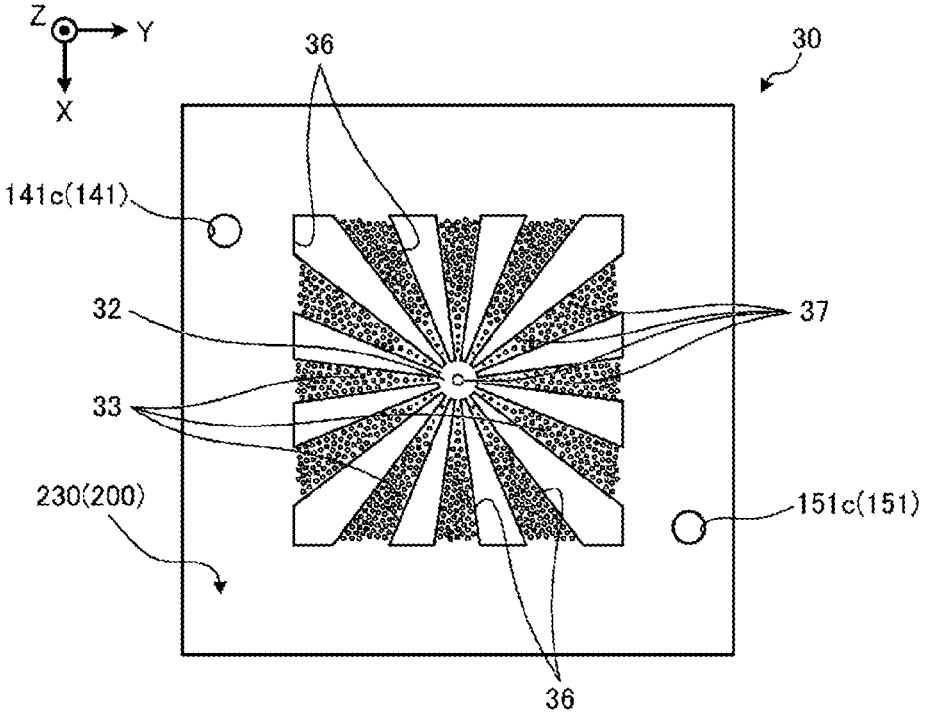
FIG. 4 is a view in which an intermediate member according to an embodiment is viewed from the Z-axis positive direction side toward the Z-axis negative direction.

The configuration of the intermediate member 30 will be described with reference to FIG. 4. FIG. 4 is a view in which an intermediate member 30 according to the embodiment is viewed from the Z-axis positive direction side toward the Z-axis negative direction.

As illustrated in FIG. 4, the intermediate member 30 has a third frame region 230 having a rectangular frame shape. The third frame region 230 constitutes a part of the frame region 200. The intermediate member 30 includes a circular center portion 32 in a plan view located inside the third frame region 230 and a plurality of connections 33 located between the center portion 32 and the third frame region 230 and connecting the center portion 32 and the third frame region 230. In the example illustrated in FIG. 4, the center portion 32 is located at the center of intermediate member 30. The plurality of connections 33 are spaced apart from each other and extends radially while widening from the center portion 32 toward the third frame region 230.

The intermediate member 30 also includes a plurality of vapor holes 36 and a plurality of reflux holes 37. Each of the plurality of vapor holes 36 and each of the plurality of reflux holes 37 extend through the upper surface (first surface) and the lower surface (second surface) of the intermediate member 30.

The plurality of vapor holes 36 function as a part of a path for the vapor of the actuating fluid. Each of the plurality of vapor holes 36 is located between two adjacent connections 33. That is, the plurality of vapor holes 36 and the plurality of connections 33 are alternately located in the circumferential direction. Being the same as and/or similar to the plurality of connections 33, the plurality of vapor holes 36 are spaced apart from each other and extends radially while widening from the center portion 32 toward the third frame region 230.

The plurality of reflux holes 37 function as a part of a path for the actuating fluid. The reflux holes 37 are micropores, each having an opening area smaller than the vapor holes 36 described above. Specifically, the reflux holes 37 are small enough to allow capillary phenomenon to occur in the actuating fluid passing through the reflux holes 37.

In the third frame region 230, a plurality (here, two) of through holes 141*c*, 151*c* are located extending through the intermediate member 30 in the thickness direction (here, in the Z-axis direction). The through hole 141*c* constitutes a part of the first portion 141 of the communication path 14, and the through hole 151*c* constitutes a part of the first portion 151 of the communication path 15.

Figure 5:
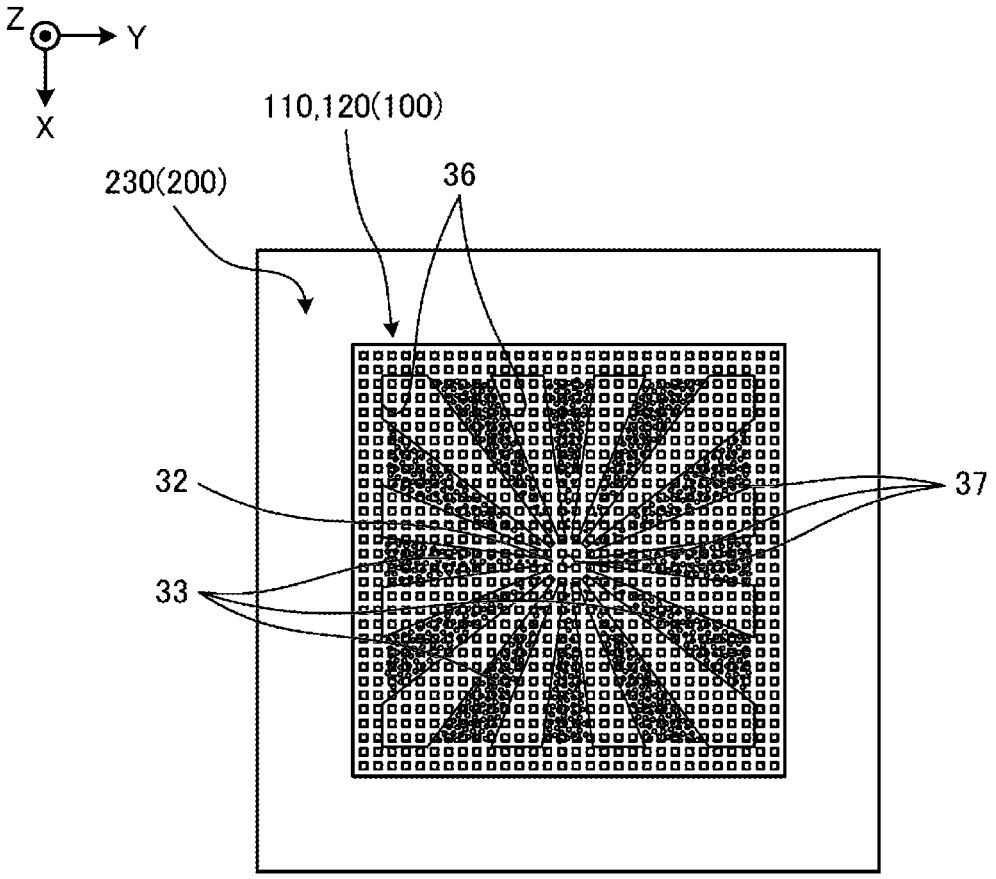
FIG. 5 is a view in which a first groove forming region illustrated in FIG. 2 and a second groove forming region illustrated in FIG. 3 are superimposed on the intermediate member illustrated in FIG. 4.

FIG. 5 is a view in which the first groove forming region 110 illustrated in FIG. 2 and the second groove forming region 120 illustrated in FIG. 3 are superimposed on the intermediate member 30 illustrated in FIG. 4. In FIG. 5, the communication paths 14, 15 are omitted for ease of understanding.

As illustrated in FIG. 5, the first and second groove forming regions 110, 120 overlap the third frame region 230 of the intermediate member 30. That is, the first and second groove forming regions 110, 120 spread outward from a region (hereinafter referred to as a "hole forming region") where the plurality of vapor holes 36 and the plurality of reflux holes 37 are formed in the intermediate member 30.

Thus, by making the first groove forming region 110 of the first member 10 and the second groove forming region 120 of the second member 20 wider than the hole forming region of the intermediate member 30, the internal space of the heat dissipation device 1 can be expanded outward compared to a case in which the first and second groove forming regions 110, 120 have the size same as or similar to the size of the hole forming region.

The heat source is disposed at the center portion of the heat dissipation device 1. The temperature of the heat dissipation device 1 becomes lower as it is away from the heat source, that is, as it becomes closer to the outer peripheral portion of the heat dissipation device 1. The vapor of the actuating fluid condenses into a liquid upon moving to a low-temperature region. By spreading the internal space of the heat dissipation device 1 outward, condensation of the actuating fluid is more likely to occur. This makes it difficult for dryout to occur.

Here, an example in which the first groove forming region 110 and the second groove forming region 120 spread outward from the hole forming region of the intermediate member is illustrated; however, the configuration is not limited to this, the hole forming region of the intermediate member 30 may spread outward from the first groove forming region 110 and the second groove forming region 120.

The actuating region 100 of the heat dissipation device 1 has an internal space sandwiched between the first groove forming region 110 and the second groove forming region 120, and an actuating fluid is enclosed in the internal space. The intermediate member is interposed between the first and second groove forming regions 110, 120 in the internal space, so that the actuating region 100 is partitioned into a first space sandwiched between the first groove forming region 110 and the intermediate member 30 and a second space sandwiched between the second groove forming region 120 and the intermediate member 30. The first space and the second space are connected via the vapor holes 36 and the reflux holes 37 formed in the intermediate member 30.

Figure 6:
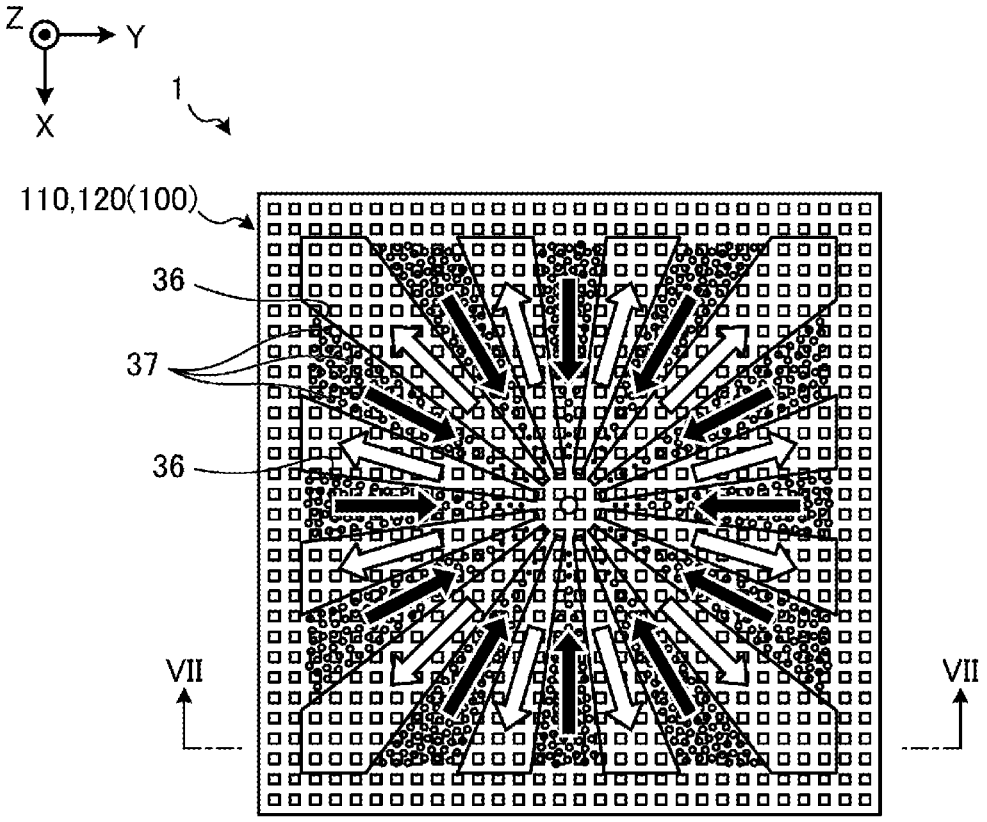
FIG. 6 is a view illustrating the flow of an actuating fluid in a heat dissipation device according to an embodiment.
Figure 7:
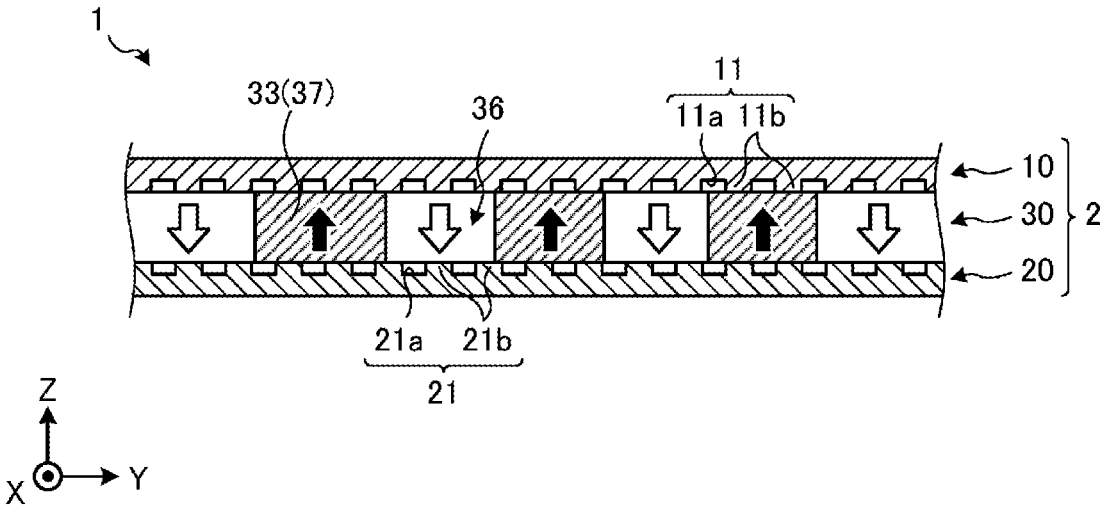
FIG. 7 is an explanatory view for explaining the flow of an actuating fluid in the heat dissipation device according to the embodiment.

The flow of the actuating fluid in the heat dissipation device 1 according to the embodiment is described with reference to FIGS. 6 and 7. FIGS. 6 and 7 illustrate the flow of the actuating fluid in the heat dissipation device 1 according to the embodiment. FIG. 6 is a view in which the third frame region 230 is omitted from the view illustrated in FIG. 5, and FIG. 7 is a cross-sectional view taken along arrow VII-VII in FIG. 6. In FIGS. 6 and 7, the vapor flow is indicated by white arrows, and the liquid flow is indicated by black arrows.

The actuating fluid is vaporized into a vapor by being heated by a heat source. As described above, the heat source is disposed at the center portion of the upper surface (fifth surface) of the first member 10 (see FIGS. 1 and 2). Thus, the vapor of the actuating fluid is generated at the center portion of the first space (the space sandwiched between the first member 10 and the intermediate member 30).

The vapor of the actuating fluid diffuses in the in-plane direction (XY plane direction) of the heat dissipation device 1 through the first groove portion 11 of the first groove forming region 110 (see white arrows in FIG. 6), while moving through the plurality of vapor holes 36 to the second space (space sandwiched between the second member 20 and intermediate member 30) (see white arrows in FIG. 7).

The vapor that has moved to the second space condenses into a liquid as the temperature decreases. The liquefied actuating fluid moves through the second groove forming region 120 toward the center portion of the heat dissipation device 1 due to the capillary action of the second groove portion 21 (see black arrows in FIG. 6). In this process, the actuating fluid enters the reflux holes 37 and is returned to the first space by the capillary action of the reflux holes 37 (see the black arrows in FIG. 7). By repeating the above cycle, the heat dissipation device 1 can transfer heat from the heat source.

Figure 8:
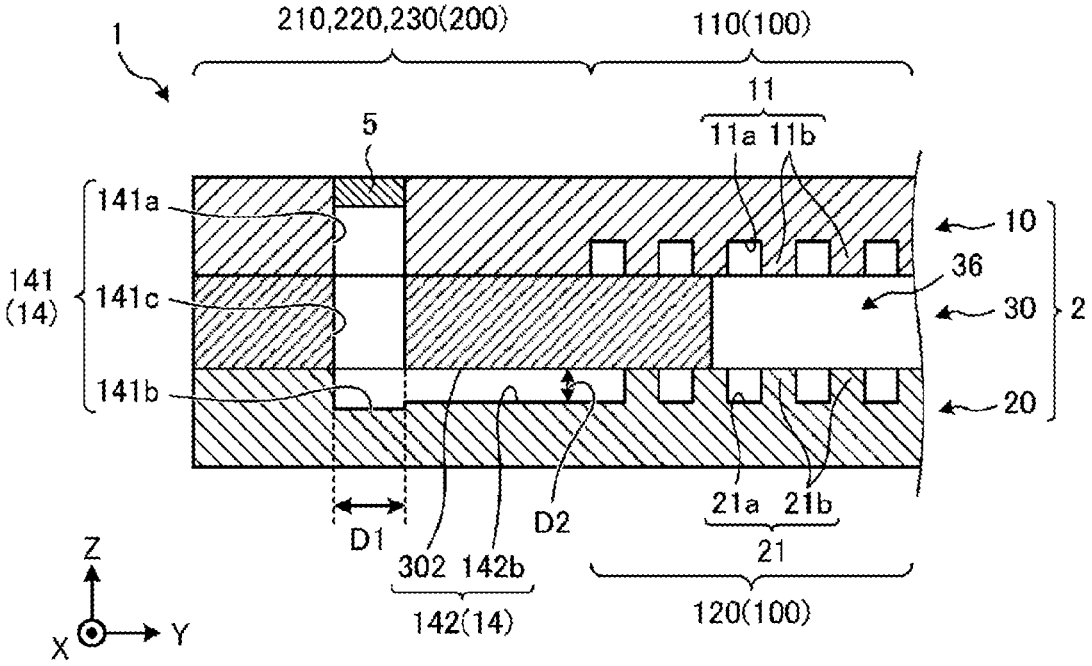
FIG. 8 is a schematic cross-sectional view illustrating a configuration example of a communication path.

The configuration of the communication paths 14, 15 is described with reference to FIG. 8. FIG. 8 is a schematic cross-sectional view illustrating a configuration example of the communication path 14. Although the communication path 14 is illustrated in FIG. 8 as an example, the communication path 15 has the same or similar configuration as/to the communication path 14.

As illustrated in FIG. 8, the communication path 14 connects the internal space of the actuating region 100 with the outside. The communication path 14 includes a first portion 141 extending in the thickness direction (here, the Z-axis direction) of the container 2 and opening to the outside, and a second portion 142 extending in the surface direction (here, the Y-axis direction) of the container 2 and opening to the internal space of the actuating region 100.

The first portion 141 is composed of a through hole 141*a* of the first member 10, a recessed portion 141*b* of the second member 20, and a through hole 141*c* of the intermediate member 30. The second portion 142 is composed of a groove portion 142*b* of the second member 20 and a lower surface 302 (second surface) of the intermediate member 30. FIG. 8 illustrates an example in which the recessed portion 141*b* of the communication path 14 is recessed deeper than the groove portion 142*b* of the second portion 142, but the recessed portion 141*b* and the groove portion 142*b* may be flush with each other.

Thus, the communication path 14 includes the first portion 141 extending in the first direction (here, the Z-axis direction) and the second portion 142 extending in the direction (here, the Y-axis direction) intersecting the first direction. In other words, the communication path 14 is bent. Therefore, according to the heat dissipation device 1 of the embodiment, even when a high pressure is generated in the actuating region 100, the high pressure is unlikely to be applied to the sealing portion 5, thus increasing the reliability.

In a cross-sectional view (that is, a cross-sectional view illustrated in FIG. 8) of the communication path 14 when cut along the thickness direction (here, the Z-axis direction) of the container 2, a path width (a width along the Y-axis direction) of the first portion 141 is defined as D1, and a path width (a width along the Z-axis direction) of the second portion 142 is defined as D2. In this case, the path width D2 of the second portion 142 is less than the path width D1 of the first portion 141. In other words, the cross-sectional area of the path of the second portion 142 is smaller than the cross-sectional area of the path of the first portion 141.

Such a configuration can suppress the entry of the actuating fluid into the communication path 14 from the actuating region 100. This suppresses a decrease in the amount of the actuating fluid in the actuating region 100, thus restraining deterioration of the heat dissipation characteristic. A large cross-sectional area of the path of the first portion 141 facilitates injection of the actuating fluid during the manufacturing process of the heat dissipation device 1.

The first portion 141 is open to the upper surface of the first member 10 and extends through the first and second spaces of the actuating region 100 in the frame region 200. The second portion 142 is located in the frame region 200 on the second space side of the actuating region 100.

In the heat dissipation device 1, the first space side of the first space and the second space is under high pressure. In other words, the first space and the second space, the second space side has a relatively low pressure. The second portion 142 located on the second space side can suppress application of a high pressure to the communication path 14.

As illustrated in FIG. 1, the communication path 14 is located so as to sandwich the actuating region 100 between the communication path 14 and the communication path 15. By arranging the two communication paths 14, 15 in this manner, a localized drop of durability can be suppressed, as compared to a case, for example, in which the two communication paths 14, 15 are arranged side by side.

Figure 9:
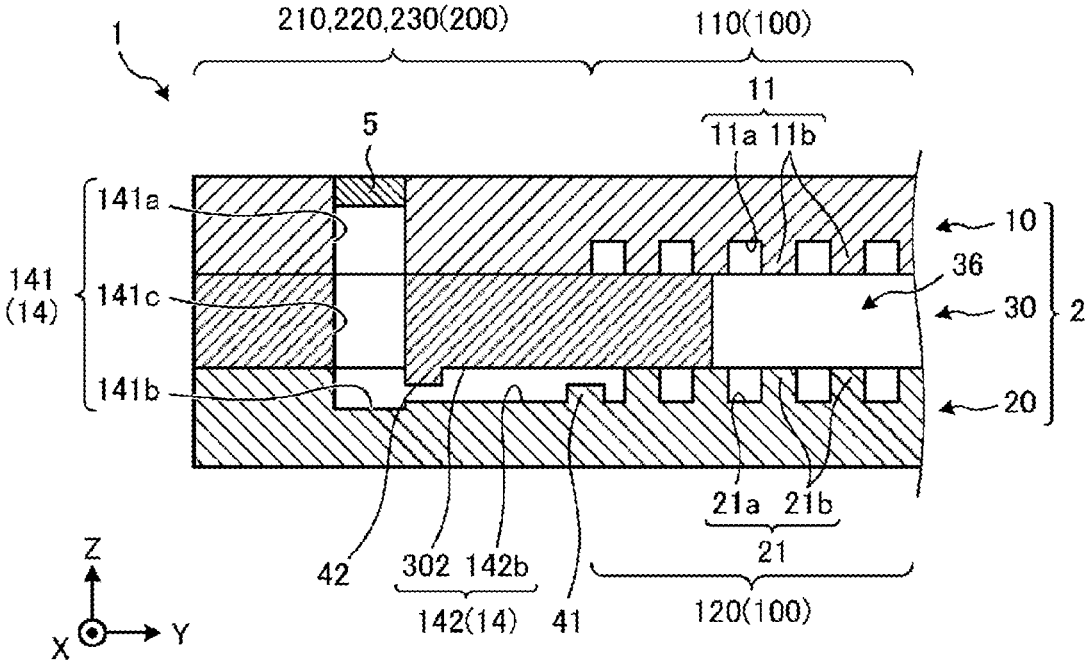
FIG. 9 is a schematic cross-sectional view illustrating another configuration example of the communication path.
Figure 10:
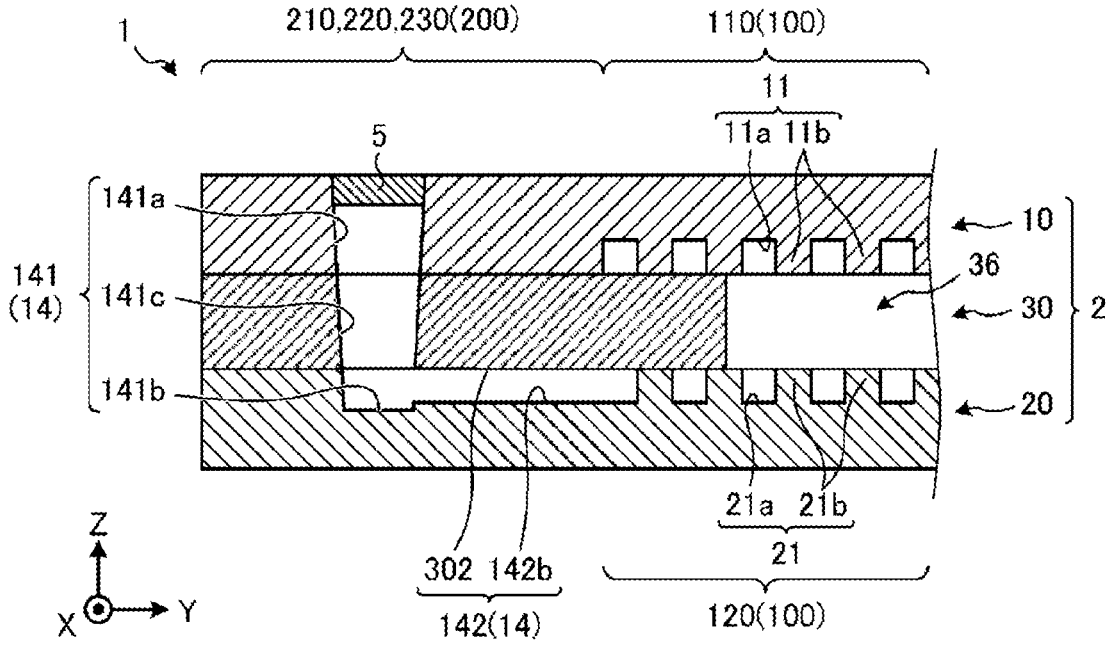
FIG. 10 is a schematic cross-sectional view illustrating another configuration example of the communication path.
Figure 11:
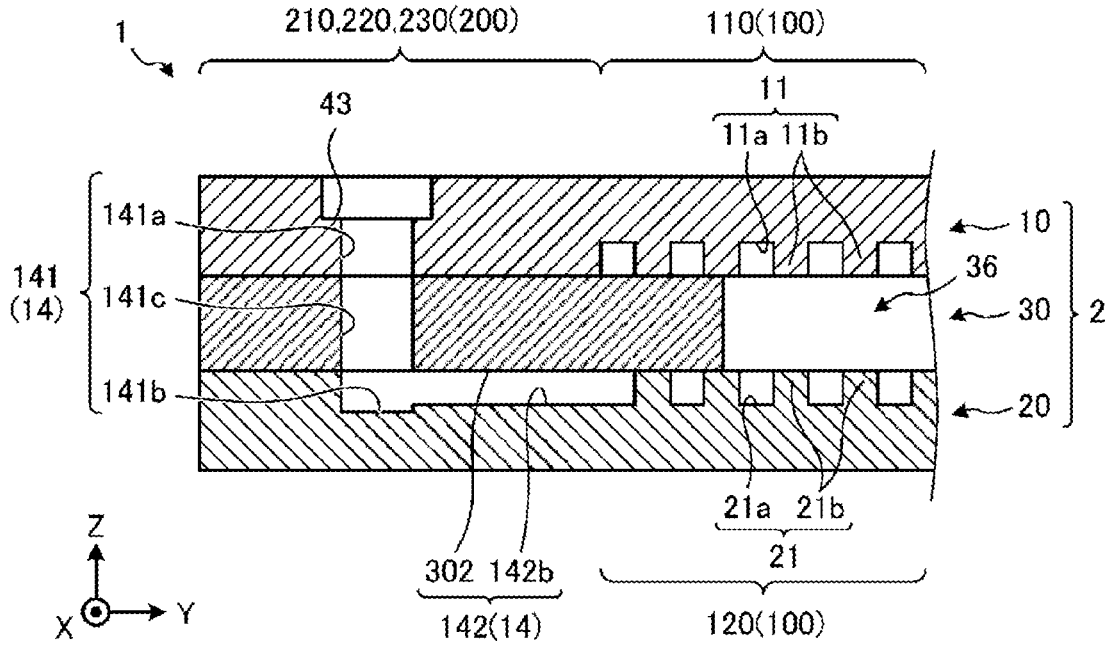
FIG. 11 is a schematic cross-sectional view illustrating another configuration example of the communication path.

FIGS. 9 to 11 are schematic cross-sectional views illustrating configuration examples of the communication path 14. In FIG. 11, the sealing portion 5 is omitted for ease of understanding.

As illustrated in FIG. 9, the second portion 142 may have a protruding portion 41 that protrudes from the bottom surface of the groove portion 142*b*, that is, the upper surface (fourth surface) of the second member 20 toward the lower surface (second surface) of the intermediate member 30. The second portion 142 may have a protruding portion 42 that protrudes from the lower surface 302 (second surface) of the intermediate member 30 toward the bottom surface of the groove portion 142*b*.

Thus, when the protruding portions 41, 42 are located in the second portion 142, the path width D2 (see FIG. 8) of the second portion 142 is partially narrowed. This suppresses the entry of the actuating fluid located in the second space of the actuating region 100 into the communication path 14. By providing the protruding portion 41 protruding from the bottom portion of the groove portion 142*b* side and the protruding portion 42 protruding from the lower surface (second surface) of the intermediate member 30 in the second portion 142 to form a labyrinth structure at the second portion 142, the entry of the actuating fluid into the communication path 14 can further be suppressed.

FIG. 9 illustrates an example in which the protruding portion 41 is located at the end portion on the actuating region 100 side of both ends of the second portion 142, and the protruding portion 42 is located at the end portion on the first portion 141 side of both ends of the second portion 142. Alternatively, the protruding portion 41 may be located at the end portion of the first portion 141 side of both ends of the second portion 142, and the protruding portion 42 may be located at the end portion of the actuating region 100 side of both ends of the second portion 142.

As illustrated in FIG. 10, the first portion 141 may be tapered with the width of the path gradually narrowing in a direction from the opening portion, which opens to the outside, toward the depth of the container 2. In other words, the first portion 141 may have a smaller cross-sectional area of the path at the connecting end connected to the second portion 142 than a cross-sectional area of the path at the opening end that opens to the outside. In this way, by narrowing the first portion 141 on the second portion 142 side, the entry of the actuating fluid into the communication path 14 from the actuating region 100 can further be suppressed. Even when the actuating fluid enters the communication path 14, the actuating fluid that has entered the communication path 14 can be returned more easily to the actuating region 100 due to the capillary action by narrowing the first portion 141.

As illustrated in FIG. 11, a stepped portion 43 extending radially outward of the first portion 141 may be provided at the opening end that opens to the outside. The stepped portion 43 expands the space in the communication path 14, relaxing the pressure applied to the communication path 14. The stepped portion 43 also increases the contact area with the sealing portion 5, thus enhancing the sealing characteristic of the actuating region 100. The stepped portion 43 facilitates the use of the helical insert, for example, as the sealing portion 5. Use of the helical insert as the sealing portion 5 facilitates connection of the heat dissipation device 1 with other members, for example.

Figure 12:
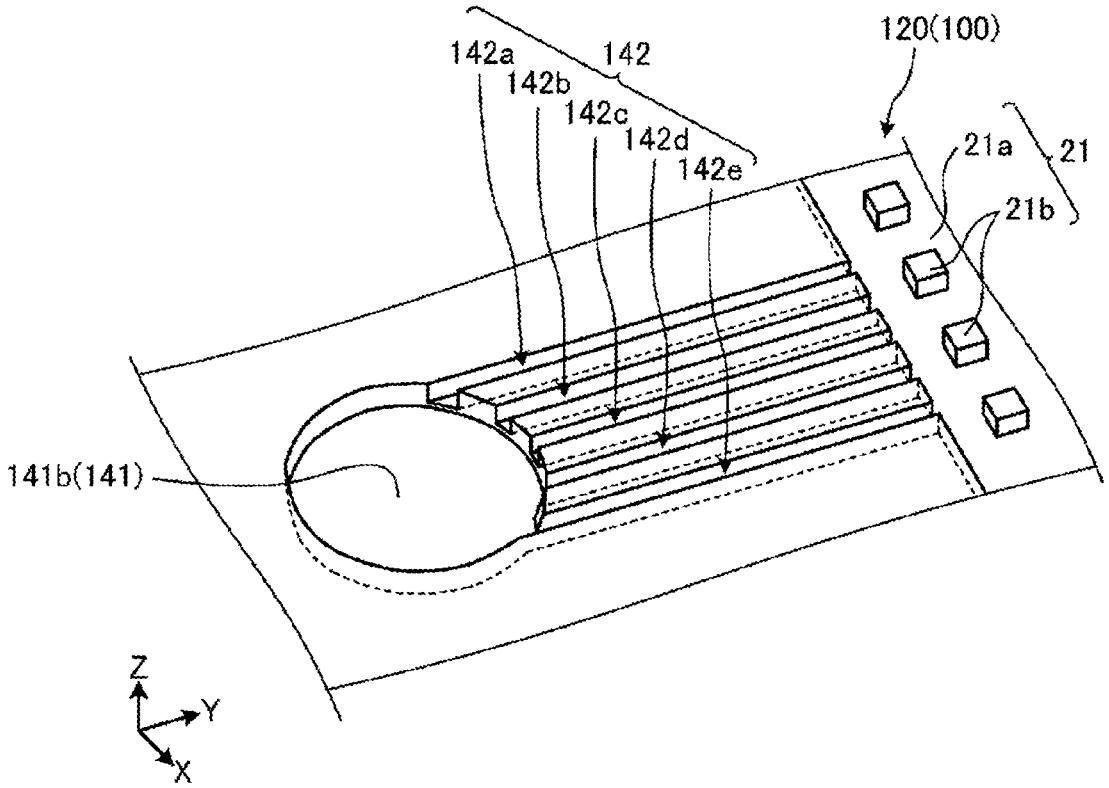
FIG. 12 is a schematic perspective view illustrating another configuration example of a second portion of the communication path.

FIG. 12 is a schematic perspective view illustrating another configuration example of the second portion 142 of the communication path 14. Specifically, FIG. 12 is an enlarged view of a peripheral portion of the second portion 142 of the upper surface (fourth surface) of the second member 20.

As illustrated in FIG. 12, the second portion 142 has a plurality of (here, five) individual paths 142*a* to 142*e*. The plurality of individual paths 142*a* to 142*e* individually connect the first portion 141 to the actuating region 100. That is, each of the individual paths 142*a* to 142*e* opens to the recess 141*b* of the first portion 141 at one end, while opening to the second groove forming region 120 at the other end.

The cross-sectional area of each of the individual paths 142*a* to 142*e* is smaller than the cross-sectional area of the path of the first portion 141. In an example, a width of each of the individual path 142*a* to 142*e* is from 150 μm to 400 μm, and a height thereof is from 100 μm to 1,000 μm.

Thus, the second portion 142 of the communication path 14 is divided into a plurality of individual paths 142*a* to 142*e*, each having a small cross-sectional area. Such a configuration further enhances the function of the capillary action compared to the case in which the second portion 142 includes one path. This allows smoother injection of the actuating fluid into the actuating region 100 in the manufacturing process of the heat dissipation device 1. This also makes it difficult to apply the high pressure of the actuating region 100 to the communication path 14 or the sealing portion 5 during the use of the heat dissipation device 1.

Individual paths 142*a* to 142*e* extend linearly from the first portion 141 toward the actuating region 100. In this case, the second protrusions 21*b* of the second groove portion 21 are not located on the extension lines of the individual paths 142*a* to 142*e*. In other words, the individual paths 142*a* to 142*e* are each provided at a position that passes between two adjacent second protrusions 21*b* when the individual paths 142*a* to 142*e* extend toward the actuating region 100. Providing the individual paths 142*a* to 142*e* at such positions can make it difficult to obstruct the flow of the actuating fluid from the communication path 14 to the actuating region 100 by the second protrusions 21*b*.

Note that FIG. 12 illustrates an example in which the second protrusions 21*b* are not located on all extension lines of the individual paths 142*a* to 142*e*, but the second protrusions 21*b* may not be located on the extension line of at least one of the individual paths 142*a* to 142*e*.

FIGS. 13 to 16 are schematic plan views illustrating other configuration examples of the individual paths 142*a* to 142*e*.

Figure 13:
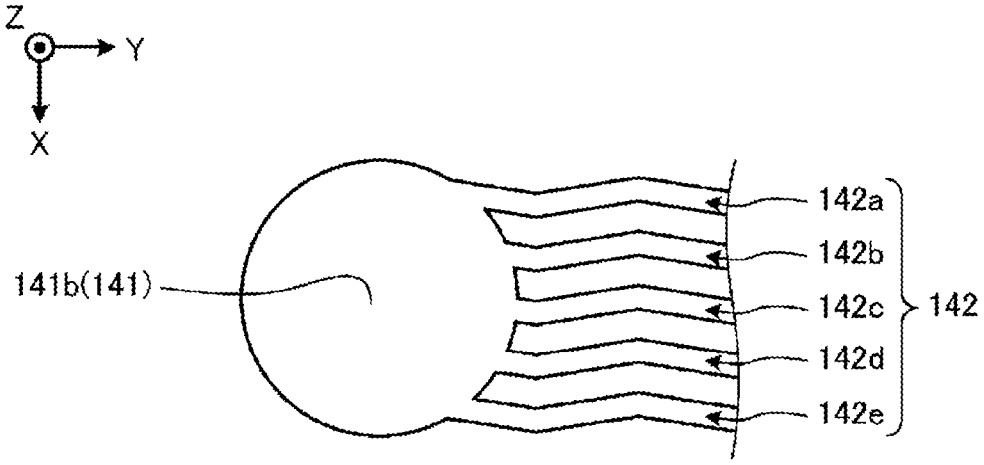
FIG. 13 is a schematic plan view illustrating another configuration example of individual paths.

As illustrated in FIG. 13, the individual paths 142*a* to 142*e* may extend in the second direction (the Y-direction) in a meandering manner in the plane (the XY plane) of the upper surface (fourth surface) of the second member 20. Such a configuration can increase the resistance of the flow path in the individual paths 142*a* to 142*e*. This further suppresses the entry of the actuating fluid in the actuating region 100 into the communication path 14.

Figure 14:
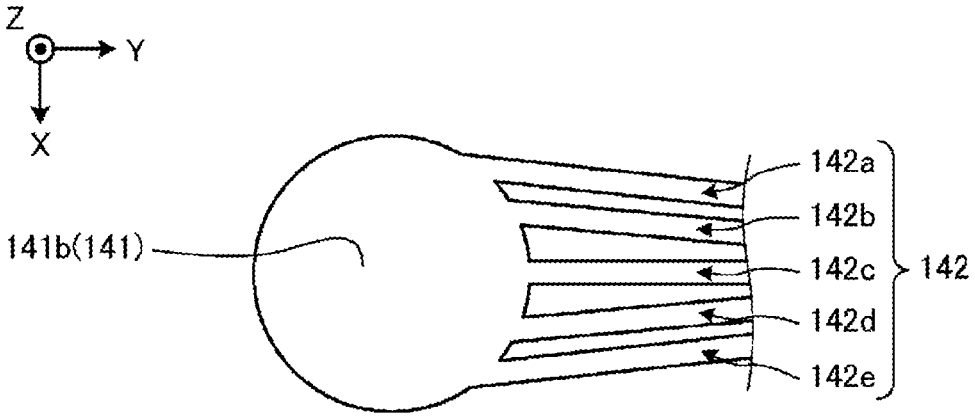
FIG. 14 is a schematic plan view illustrating another configuration example of the individual paths.
Figure 15:
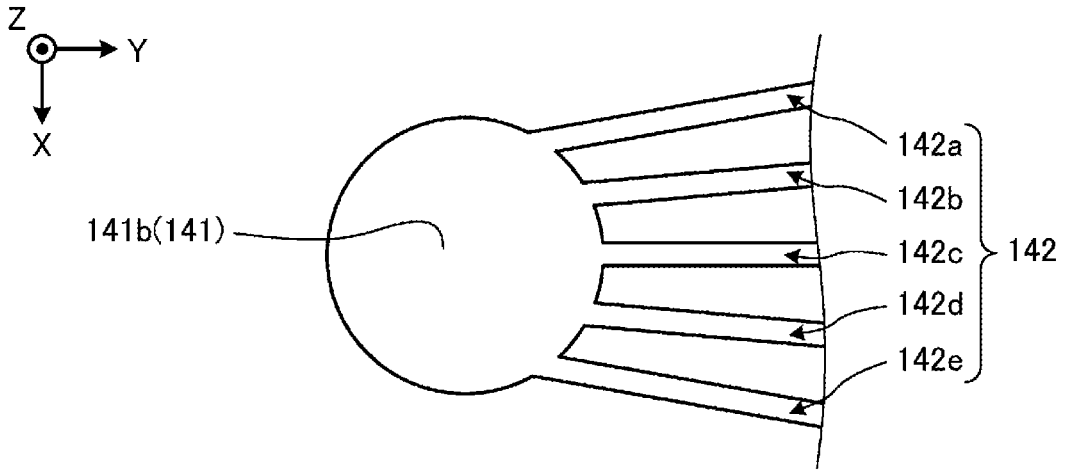
FIG. 15 is a schematic plan view illustrating another configuration example of the individual paths.

As illustrated in FIG. 14, the individual paths 142*a* to 142*e* may approach each other from the first portion 141 toward the actuating region 100. Alternatively, as illustrated in FIG. 15, the individual paths 142*a* to 142*e* may be separated from each other in a direction from the first portion 141 toward the actuating region 100.

As described above, the plurality of individual paths 142*a* to 142*e* do not necessarily need to extend in the same direction. The extending directions of the plurality of individual paths 142*a* to 142*e* may differ from each other, and thus it makes it possible, for example, to obtain the communication path 14 in which the flow direction of the actuating fluid flowing into the actuating region 100 from the individual paths 142*a* to 142*e* is adjusted not to hit the second protrusions 21*b* located in the actuating region 100 as much as possible.

Figure 16:
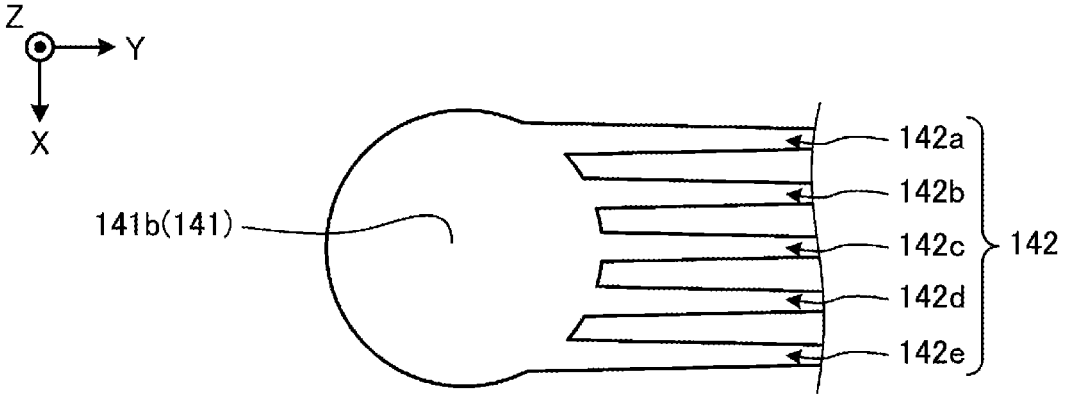
FIG. 16 is a schematic plan view illustrating another configuration example of the individual paths.

As illustrated in FIG. 16, each of the individual paths 142*a* to 142*e* may be tapered with a cross-sectional area decreasing from the first portion 141 toward the actuating region 100. Such a configuration facilitates the entry of the actuating fluid into the actuating region 100 from the first portion 141 due to the capillary action that gradually increases from the first portion 141 toward the actuating region 100. In other words, the entry of the actuating fluid into the communication path 14 from the actuating region 100 can further be suppressed.

An example of a method for manufacturing the heat dissipation device 1 according to the embodiment is described. First, green sheets are formed by a doctor blade method or a roll compaction method using materials of the first member 10, the second member 20 and the intermediate member 30. Then, by layering a plurality of respective green sheets, a laminate body is obtained.

Subsequently, the obtained laminate body is subjected to laser processing or die punching, thereby obtaining the respective compacts of the first member 10, the second member 20 and the intermediate member 30. For example, a compact of the intermediate member 30 with through holes 141*c*, 151*c*, a plurality of vapor holes 36, and a plurality of reflux holes 37 can be obtained by applying laser processing to the laminate body. By applying laser processing to the resulting laminate body, a compact of the first member 10 in which the through holes 141*a*, 151*a* and the first groove forming region 110 are formed is obtained. By applying laser processing to the resulting laminate body, a compact of the second member 20 with the recessed portions 141*b*, 151*b*, the groove portions 142*b*, 152*b*, and the second groove forming region 120 is obtained.

Subsequently, the compacts of the first member 10, the second member 20, and the intermediate member 30 are respectively stacked and fired in the order of the second member 20, the intermediate member 30, and the first member 10 to obtain a sintered body of the container 2 in which the first member 10, the second member 20, and the intermediate member 30 are integrated. In this way, the first member 10, the second member 20 and the intermediate member 30 are integrally formed. Since no adhesive or the like is necessary, the highly reliable heat dissipation device 1 can be obtained.

The method of obtaining the respective compacts of the first member 10, the second member 20, and the intermediate member 30 is not limited to the method described above. For example, the green sheets may be processed and then laminated to obtain the compacts. In the above example, the compact of the container 2 is obtained by fabricating the respective compacts of the first member 10, the second member 20, and the intermediate member 30 individually and then stacking them. Alternatively, the compact of the container 2 may be obtained by sequentially stacking processed green sheets, for example.

Subsequently, the actuating fluid is injected into the sintered body from one of the communication paths 14, 15, for example. The gas present in the sintered body is discharged to the outside from the other of the communication paths 14, 15, in accordance with injection of the actuating fluid.

Subsequently, a vacuum pump or other pressure reducing device is used to evacuate the inside of the sintered body through the communication paths 14, 15. The inner portion of the sintered body is desirably in a vacuum, but it may not be in a strict vacuum state and, for example, may be under reduced pressure close to a vacuum state. Subsequently, the communication paths 14, 15 are sealed in a state in which the inside of the sintered body is evacuated. In this way, the communication paths 14, 15 are sealed by the sealing portion 5, and the heat dissipation device 1 is obtained.

As described above, the thermal device (for example, the heat dissipation device 1) according to the embodiment is a thermal device that utilizes the latent heat of a phase transformation substance (for example, the actuating fluid), and the thermal device includes a ceramic container (for example, the container 2) and a sealing portion (for example, the sealing portion 5). The container includes a phase transformation region (for example, the actuating region 100) in which a phase transformation substance is sealed, a frame region (for example, the frame region 200) surrounding the phase transformation region, and communication paths (for example, the communication paths 14, 15) configured to connect the phase transformation region with the outside. The sealing portion blocks the communication paths. The communication paths are located in the frame region.

Thus, the thermal device according to the embodiment can enhance the durability.

The thermal device according to the present disclosure is not limited to the heat dissipation device. For example, the thermal device according to the present disclosure may be a thermal storage device that stores latent heat associated with phase transformation of a thermal storage material (an example of the phase transformation substance) as thermal energy. In that case, a material that performs solid-liquid phase transformation or a material that performs solid-solid phase transformation is used as the heat storage material. Thus, the phase transformation substance is not necessarily required to undergo gas-liquid phase transformation. In other words, the phase transformation substance does not necessarily be liquid, but may be solid.

Note that the embodiments disclosed herein are exemplary in all respects and not restrictive. The aforementioned embodiments can be embodied in a variety of forms. The above-described embodiments may be omitted, substituted or modified in various forms without departing from the scope and spirit of the appended claims.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A thermal device that utilizes latent heat of a phase transformation substance, comprising:

a ceramic container comprising a phase transformation region in which the phase transformation substance is enclosed, a frame region surrounding the phase transformation region, and a communication path configured to connect the phase transformation region with the outside; and a sealing portion configured to block the communication path and seal the phase transformation substance within the phase transformation region, wherein the communication path is located in the frame region, wherein the communication path comprises a first portion extending in a first direction and opening to the outside, and a second portion extending in a second direction intersecting the first direction and opening to the phase transformation region, and wherein the container comprises an intermediate member having a plate shape and comprising a plurality of reflux holes extending through a first surface and a second surface located on an opposite side of the first surface, a first member comprising a first groove portion on a third surface facing the first surface of the intermediate member, and comprising a heat source disposed on a fifth surface opposite to the third surface, and a second member comprising a second groove portion on a fourth surface facing the second surface of the intermediate member, wherein an actuating fluid is located as the phase transformation substance in the phase transformation region sandwiched between the first groove portion and the second groove portion, and wherein the phase transformation region comprises a first space sandwiched between the first surface of the intermediate member and the third surface of the first member, and a second space sandwiched between the second surface of the intermediate member and the fourth surface of the second member, the first portion extends across the first space and the second space in the frame region in a cross-sectional view of the container, and the second portion is located on the second space side of the first space and the second space in the frame region in the cross-sectional view of the container.

2. The thermal device according to claim 1, wherein a cross-sectional area of a path at the second portion is smaller than a cross-sectional area of a path at the first portion.

3. The thermal device according to claim 1, wherein the second portion comprises a plurality of individual paths each having a cross-sectional area smaller than a cross-sectional area of a path at the first portion.

4. The thermal device according to claim 3, wherein the plurality of individual paths extend in the second direction in a meandering manner.

5. The thermal device according to claim 3, wherein the plurality of individual paths approach each other further from the first portion toward the phase transformation region.

6. The thermal device according to claim 3, wherein the plurality of individual paths are separated from each other further from the first portion toward the phase transformation region.

7. The thermal device according to claim 3, wherein the individual paths each have a cross-sectional area that is smaller from the first portion toward the phase transformation region.

8. The thermal device according to claim 1, wherein the second portion comprises a protruding portion protruding from a surface facing the second surface toward the second surface.

9. The thermal device according to claim 7, wherein the first portion has a smaller cross-sectional area of the path at a connecting end connected to the second portion than a cross-sectional area of the path at an opening end that opens to the outside.

10. The thermal device according to claim 7, wherein the first portion comprises a stepped portion at the opening end that opens to the outside.

11. The thermal device according to claim 7, comprising:

at least two of the communication paths, wherein one of the communication paths is located with the phase transformation region sandwiched between the one of the communication paths and the other communication path.

* * * * *